US009053917B2

(12) United States Patent
Ivaldi et al.

(10) Patent No.: US 9,053,917 B2
(45) Date of Patent: Jun. 9, 2015

(54) VACUUM FIRED AND BRAZED ION PUMP ELEMENT

(71) Applicant: Agilent Technologies, Inc., Loveland, CO (US)

(72) Inventors: Stefania Ivaldi, Loveland, CO (US); Cristian Maccarrone, Loveland, CO (US); Michele Mura, Loveland, CO (US); Pierino Fiorito, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 29 days.

(21) Appl. No.: 13/853,728

(22) Filed: Mar. 29, 2013

(65) Prior Publication Data

US 2014/0292186 A1 Oct. 2, 2014

(51) Int. Cl.

| | |
|---|---|
| ***H01J 9/02*** | (2006.01) |
| ***H01J 41/12*** | (2006.01) |
| ***H01J 41/20*** | (2006.01) |

(52) U.S. Cl.

CPC ..... *H01J 41/20* (2013.01)

(58) Field of Classification Search

USPC ..... 313/558, 330, 58; 378/125–144; 427/209, 360; 148/535

See application file for complete search history.

(56) References Cited

U.S. PATENT DOCUMENTS

| | | | | |
|---|---|---|---|---|
| 2,945,150 | A | 7/1960 | De Santis et al. | |
| 3,331,975 | A | 7/1967 | Jepsen | |
| 3,540,812 | A * | 11/1970 | Henderson et al. | 417/49 |
| 3,614,264 | A | 10/1971 | Gunther | |
| 4,185,365 | A * | 1/1980 | Hueschen et al. | 445/28 |
| 4,742,527 | A * | 5/1988 | Wiedemann et al. | 372/87 |
| 5,725,408 | A | 3/1998 | Boettcher | |
| 6,674,838 | B1 * | 1/2004 | Barrett | 378/125 |
| 2007/0205253 | A1 | 9/2007 | Hubner | |
| 2009/0020585 | A1 * | 1/2009 | Fukumoto et al. | 228/56.3 |

FOREIGN PATENT DOCUMENTS

| | | | |
|---|---|---|---|
| CN | 1610041 | A | 4/2005 |
| GB | 1070915 | | 6/1967 |
| GB | 1530411 | | 11/1978 |
| JP | 56015533 | A | 2/1981 |
| JP | 59093993 | A | 5/1984 |

* cited by examiner

*Primary Examiner* — Tracie Y Green

(57) ABSTRACT

A Vacuum Fired and Brazed ("VFB") anode array element for use in an ion pump is described. The VFB anode array element includes a first VFB conduit anode element and second VFB conduit anode element, wherein the second VFB conduit anode element is adjacent the first VFB conduit anode element. The first VFB conduit anode element is vacuum brazed together with second VFB conduit anode element.

20 Claims, 11 Drawing Sheets

VACUUM FIRED AND BRAZED ION PUMP ELEMENT

BACKGROUND OF THE INVENTION

1. Field of the Invention

This invention relates generally to vacuum pumps and more particularly to ion pump elements.

2. Related Art

An ion pump (also referred to as a sputter ion pump) is a type of known vacuum capture pump capable of reaching pressures as low as $10^{-11}$ mbar under ideal conditions. An ion pump is a device that ionizes gas within a vessel (to which the ion pump is attached) and employs a strong electrical potential, typically 3 kV to 7 kV, that allows the gas ions to accelerate into and be captured by a solid electrode and its residue.

The basic element of a known ion pump is a Penning trap. Penning traps are devices for the storage of charged particles using a homogeneous static magnetic field and a spatially inhomogeneous static electric field. Penning traps use a strong homogeneous axial magnetic field to confine particles radially and a quadrupole electric field to confine the particles axially. In FIG. 1, a perspective view of an example of an implementation of a known Penning trap 100 is shown.

The static electric potential can be generated using a set of three electrodes: a ring 102 and two end-caps 104 and 106 between a magnet 108. In this example, the ring 102 is an anode element, such as a cylindrical anode of stainless steel, and the end-caps 104 and 106 are cathodes. For trapping of ions, the end-cap electrodes 104 and 106 are kept at a negative potential relative to the cylindrical anode 102. This potential produces a saddle point in the center of the Penning trap 100, which traps ions along the trap axial direction 110. The electric field causes ions to oscillate along the trap axis 110. The magnetic field in combination with the electric field causes charged particles to move in the radial plane 112 with a motion which traces out a helix.

In FIG. 2, a side-view of the Penning trap 100 of FIG. 1 is shown in combination with the vessel 200 that has an inlet 202. The cathode plates 104 and 106 are shown positioned on both sides of one of the anode cylinders 102. It is appreciated that while only one anode cylinder 102 is shown for convenience, the description extends to a plurality of anode cylinders 102. Typically, the anode 102 is made of stainless steel, aluminum or other similar metals, which serves as the gettering material. A magnetic field 204 is oriented along the axis 206 of the anode 102. Electrons 208 are emitted from the cathode 104 and 106 due to the action of an electric field 210 and, due to the presence of the magnetic field 204, the electrons 208 move in long helical trajectories 212 which improves the chances of collision with gas molecules 214 inside the Penning cell 100 that are introduced via the inlet 202.

The usual result of a collision of a gas molecules 214 with the electron 208 is the creation of a positive ion 216 that is accelerated to some voltage potential by the anode voltage and moves almost directly in the direction 218 to the cathode 106. The influence of the magnetic field 204 is small because of the ion's relatively large atomic mass compared to the electron mass.

In this example, the cathodes 104 and 106 may be of titanium (tantalum, other related alloys, or other getterable metals). In the case of cathodes 104 and 106 being made of titanium, ions 216 impacting on the titanium cathode surface sputter titanium atoms (or molecules) 220 in a direction 222 away from the cathode 106 forming a getter film on the neighboring surfaces and stable chemical compounds with the reactive or "getterable" gas particles (e.g. CO, $CO_2$, $H_2$, $N_2$, $O_2$). This pumping effect is very selective for the different types of gas molecules 214 and is the dominating effect with ion pumps. The number of sputtered titanium molecules 220 is proportional to the pressure inside the ion pump. The sputtering rate depends on the ratio of the mass of the bombarding molecules 216 and the mass of the cathode material 220.

In an example of operation, a swirling cloud of electrons 208 produced by a Penning discharge within the Penning trap 100 are temporarily stored in the anode region 224 of the Penning trap 100. These electrons 208 ionize incoming gas atoms and molecules 214. The resultant swirling ions 216 are accelerated to strike the chemically active cathodes 104 and 106. On impact the accelerated ions 216 will either become buried within the cathode 104 and 106 or sputter cathode material 220 onto the walls 224 of the ion pump. The freshly sputtered chemically active cathode material 220 acts as a getter that then evacuates the gas by both chemisorption and physisorption resulting in a net pumping action.

Both the pumping rate and capacity of such capture methods are dependent on the specific gas molecules 214 being collected and the cathode material absorbing it. Some gas molecules 214, such as carbon monoxide, will chemically bind to the surface of a cathode material. Others, such as hydrogen, will diffuse into the metallic structure.

A problem with known Penning traps is that the anodes 102 are typically assembled utilizing spot welding techniques. Spot welding is a process in which the contacting metal surfaces of the anode 102 are joined by the heat obtained from resistance to electric current. These contacting metal surfaces are held together under pressure exerted by electrodes where the electrodes are typically two shaped copper alloy electrodes to concentrate welding current into a small "spot" (or spots) and to simultaneously clamp the sheets together. By forcing a large current through the spot(s) it melts the metal and form the weld.

Unfortunately, this welding process causes the introduction of impurities (through particles, contamination and/or oxidation of the anode material) into the metal of the welded anode 102. These impurities cause the ion pump to operate at less efficiency than if no impurities are introduced by introducing particles that can create leakage currents when the ion pump in operating. The problem is increased if vacuum fired cathodes are desired because generally these situations typically reach extremely low pressure ranges where the ion current is comparable to the leakage current. As such, there is a need for a process for producing anode elements that do not have the impurities produced by spot welding techniques.

SUMMARY

Described is a Vacuum Fired and Brazed ("VFB") anode array element for use in an ion pump. The VFB anode array element includes a first VFB conduit anode element and second VFB conduit anode element, wherein the second VFB conduit anode element is adjacent the first VFB conduit anode element. The first VFB conduit anode element is vacuum brazed together with second VFB conduit anode element.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In order to solve the problems described earlier, a new vacuum fired and brazed ion pump element is disclosed. Specifically, a new vacuum fired and brazed ("VFB") conduit anode element for utilization in a Penning trap is described. Additionally, a new VFB anode array element for utilization in a Penning trap is described.

Generally, joining metals by brazing utilizes the interatomic attraction between two pieces of metal to form a bond that approaches parent metal strength. This is accomplished by "wetting" the metals to be joined with molten metal which, upon cooling, forms the joint. Welding differs from brazing in that the base metals to be joined are molten at the moment of joining. More specifically, brazing is a metal joining process wherein a filler metal (generally known as a brazing alloy) is heated above its melting point and distributed between two or more close-fitting parts by capillary action. The brazing alloy is brought to slightly above its melting temperature while protected by a suitable atmosphere, usually a flux. It then flows over the base metal (i.e., wetting) and is then cooled to join the work pieces together. As an example, aluminum brazing alloys are used to braze aluminum base metals using various methods, the most common being a salt dip bath, vacuum, or flux (either torch or furnace).

Furnace brazing is a semi-automatic process used widely in industrial brazing operations with four main types of furnaces used in brazing operations: batch type; continuous; retort with controlled atmosphere; and vacuum. Vacuum brazing is a materials joining technique that offers significant advantages which include extremely clean, superior, flux-free braze joints of high integrity and strength. The process is performed inside a vacuum chamber vessel. Temperature uniformity is maintained on the work piece being brazed when heating in a vacuum that greatly reduces residual stresses due to slow heating and cooling cycles. This, in turn, improves the thermal and mechanical properties of the material being brazed, thus providing unique heat treatment capabilities such as, for example, the capability of heat-treating or age-hardening the work piece while performing a metal joining process, all in a single furnace thermal cycle. The heat is transferred using radiation.

Figure 3:
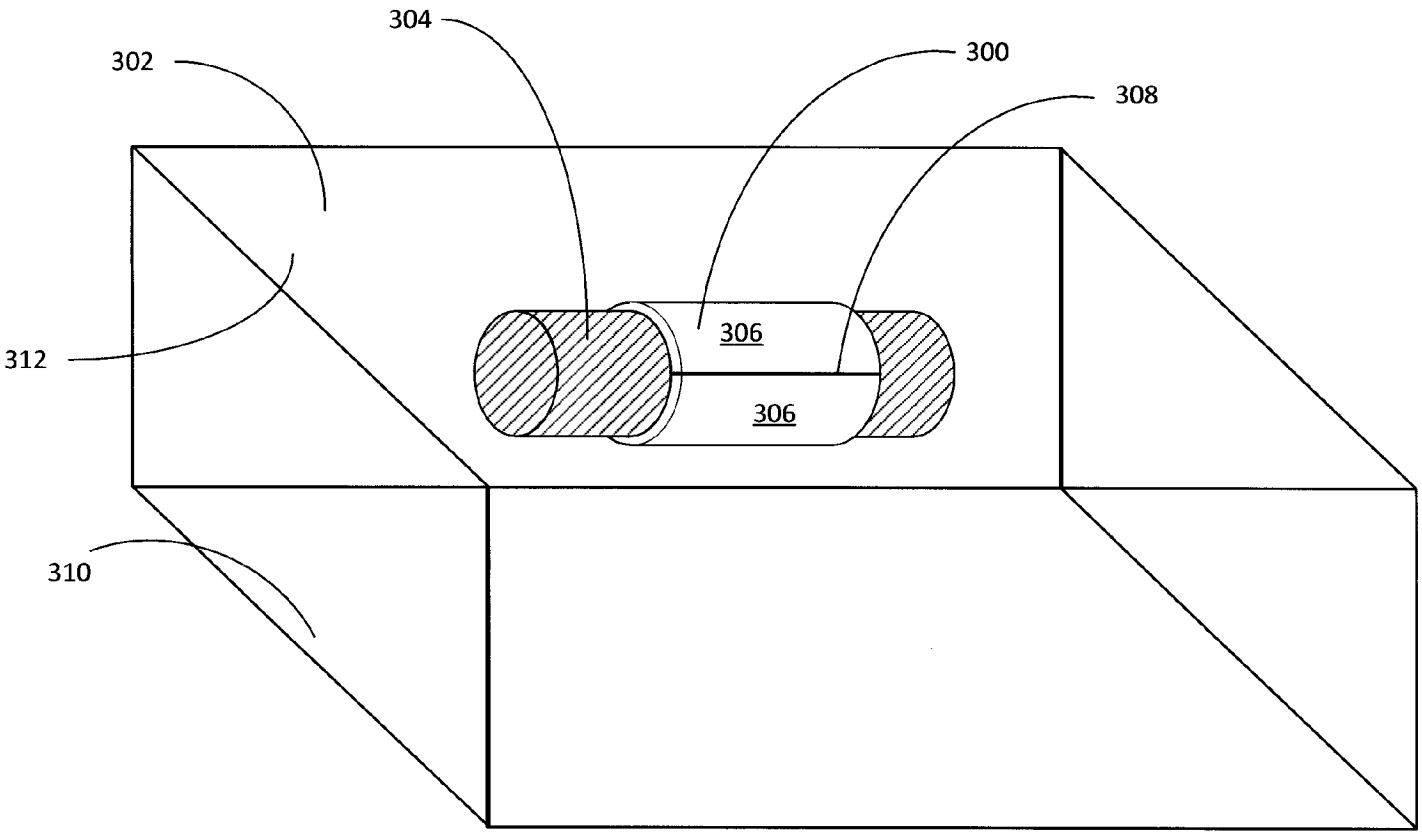
FIG. 3 is a perspective view of an example of an implementation of a vacuum fired and brazed conduit anode element (VFB conduit anode element), within a vacuum vessel, for utilization in a Penning trap in accordance with the invention.

In FIG. 3, a perspective view of an example of an implementation of a VFB conduit anode element 300, within a vacuum vessel 302 (also known as a "vacuum chamber"), is shown for utilization in a Penning trap in accordance with the invention. In this example the VFB conduit anode element 300 is cylindrical in shape and may be generally referred to as a "VFB cylindrical anode element." In this example, the VFB cylindrical anode element 300 is shown wrapped around a cylindrical tooling element 304. The vacuum vessel 302 may be any containment housing capable of holding a vacuum such as a welded or airtight sealed metal housing that has inlet for extracting any gases in the vacuum vessel 302 to produce a vacuum condition within the vacuum vessel 302. The VFB cylindrical anode element 300 may constructed from a piece (or pieces) of stainless steel (aluminum or other similar metal) sheet metal having a cylindrical surface 306. The cylindrical tooling element 304 is a solid cylindrical element made of another metal or material (such as, for example, ceramic alumina) capable of properly transferring heat through the inward and outward radial direction so as to maintain a uniform temperature of the cylindrical surface 306 which is defined by a predetermined temperature profile. The VFB cylindrical anode element 300 may have at least two sheet edges of the cylindrical surface 306 that when wrapped around the cylindrical tooling element 304 meet at a joint line 308 that is defined by physically placing the two sheet edges of the cylindrical surface 306 either close to each other or actually physically pressing against each other. In this example, one edge of the cylindrical surface 306 may be clad with a brazing alloy that when heated above its melting point melts and distributes itself between the two sheet edges of the cylindrical surface 306 by capillary action. In this example, the brazing alloy may be a copper-gold brazing alloy. Once the process ends, the brazing alloy forms the bond between the two sheet edges of the cylindrical surface 306 along the joint line 308 and structurally creates the VFB cylindrical anode element 300. The VFB cylindrical anode element 300 created using this process is an improvement over the known approaches because the bond between the two sheet edges of the cylindrical surface 306 along the joint line 308 is continuous and not the result of numerous spot welds along the joint line 308. Additionally, since a vacuum braze process has been utilized, there is no introduction of impurities into the VFB cylindrical anode element 300 such as particles, contamination and/or oxidation of the VFB cylindrical anode element 300 material.

In this example, it is appreciated by those skilled in the art, that while only one VFB cylindrical anode element 300 element is shown, in practice the disclosed technique may be utilized to create multiple VFB cylindrical anode elements within the vacuum vessel 302. Additionally, while only one joint line 308 is shown, in practice there may be multiple joint lines along the surface of the VFB cylindrical anode element based on the braze tooling used and the number of cylindrical surface 306 sheets used to create a given VFB cylindrical anode element. Moreover, while FIG. 3 shows use of a cylindrical tooling element 304, it is also appreciated that in a vacuum brazing technique other tooling elements (not shown) are needed to properly stack up the material (including the VFB cylindrical anode element) within the vacuum vessel 302 between the bottom inner surface 310 and top inner surface 312 of the vacuum vessel 302 and fully fill in the space between all the inner surfaces of the vacuum vessel 302. The reason for this is to minimize any air gaps within the vacuum vessel 302 so as to more precisely control the quality of the vacuum and the heat transfer through the material within the vacuum vessel 302.

Figure 4:
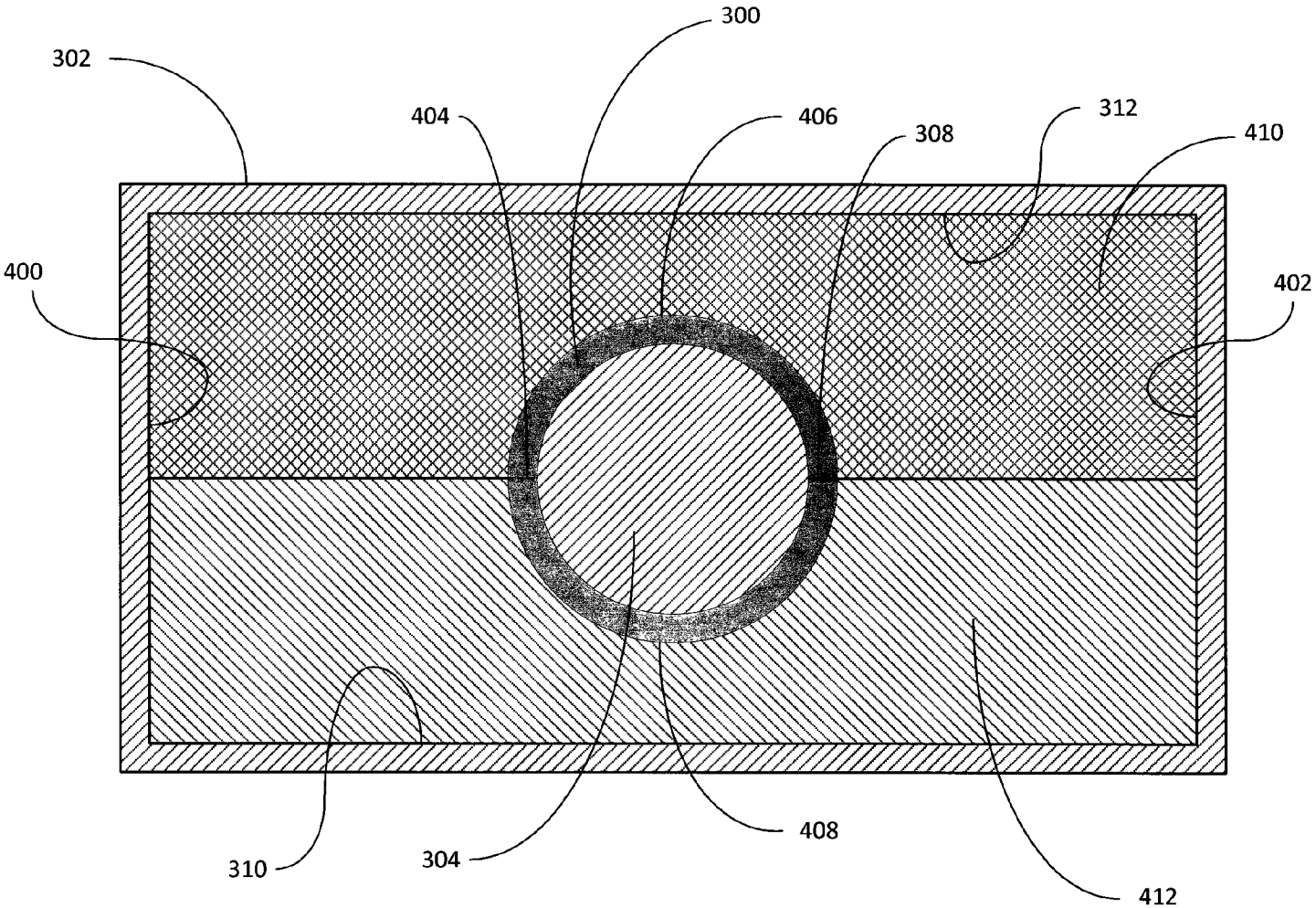
FIG. 4 is a front-view of the implementation of the VFB conduit anode element, within the vacuum vessel, shown in FIG. 3, in accordance with the invention.

Turning to FIG. 4, a front-view of the implementation of the VFB cylindrical anode element 300, within the vacuum vessel 302, shown in FIG. 3, in accordance with the invention. As already described in FIG. 3, the VFB cylinder anode element 300 is wrapped around the cylindrical tooling element 304 with a joint line 308 and the vacuum vessel 302 has a bottom inner surface 310 and top inner surface 312. Additionally, FIG. 4 shows that the vacuum vessel 302 also includes a first side inner surface 400 and a second side inner surface 402. Additionally, the VFB cylinder anode element 300 may include an optional second joint line 404 that would optionally divide the cylindrical surface 306 sheet (shown in FIG. 3) into an upper cylindrical surface 406 sheet and lower cylindrical surface 408 sheet. If the VFB cylinder anode element 300 includes the optional second joint line 404, one of the edge surfaces of the upper cylindrical surface 406 sheet and lower cylindrical surface 408 sheet includes a brazing alloy to braze together the edges of the upper cylindrical surface 406 sheet and lower cylindrical surface 408 sheet along the optional second joint line 404.

Moreover, a top tooling element 410 and lower tooling element 412 is shown that stacks above and under, respectively, the VFB cylinder anode element 300 in order to create a material stack up that completely fills in, or almost completely fills in, the space between the bottom inner surface 310 and top inner surface 312. Additionally, the top tooling element 410 and lower tooling element 412 in combination with the VFB cylinder anode element 300 and cylindrical tooling element 304 completely fills in, or almost completely fills in, the space between the first side inner surface 400 and second side inner surface 402.

Again, in this example, it is appreciated by those skilled in the art, that while only one VFB cylindrical anode element 300 element is shown, in practice the disclosed technique may be utilized to create multiple VFB cylindrical anode elements within the vacuum vessel 302. Additionally, while FIG. 4 shows use of a cylindrical tooling element 304, top tooling element 410 and lower tooling element 412, it is also appreciated that in a vacuum brazing technique other tooling elements (not shown) may be utilized based on the number of desired VFB cylindrical anode elements to be created and the temperature, time (i.e., a heat cycle), and vacuum profile utilized in the vacuum brazing technique. Moreover, it is also appreciated that in addition to the VFB cylindrical anode elements, this technique may also be employed to create the cathodes 104 and 106 either individually or in combination with the VFB cylindrical anode elements.

It is appreciated by those skilled in the art that while the examples shown describe utilizing a cylindrically shaped anode for the VFB cylindrical anode element, other shaped tubular shaped VFB anode elements may also be utilized. Examples of other types of VFB anode elements may include, for example, a metal conduits that have a cross-sectional area defined by a square, rectangular, oval, tear-shaped, star, or other similar closed shapes.

Figure 5:
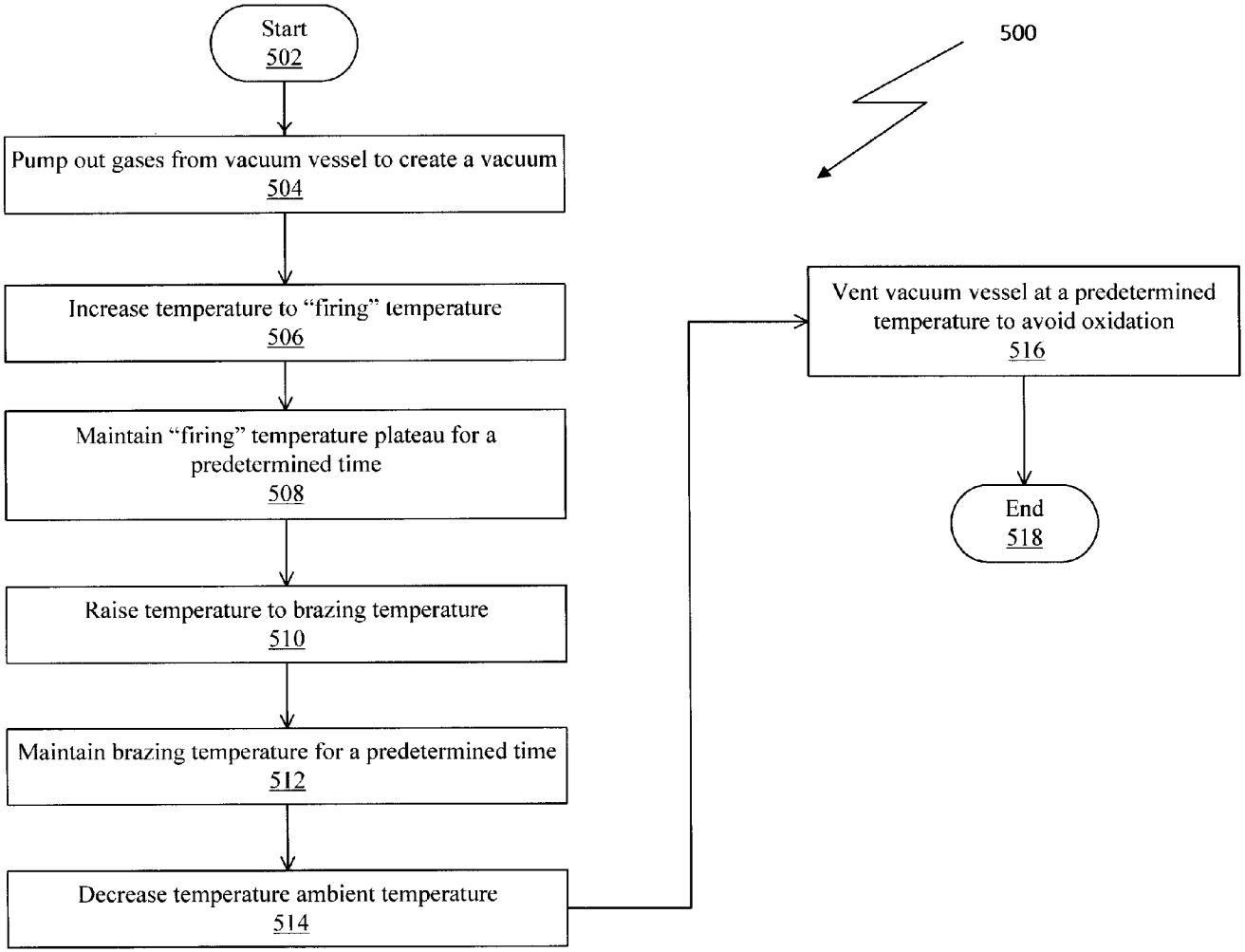
FIG. 5 is a flowchart of an example of an implementation of a brazing process for producing the VFB conduit anode element, within the vacuum vessel, shown in FIGS. 3 and 4, in accordance with the invention.

In FIG. 5, a flowchart 500 of an example of an implementation of a brazing process for producing the VFB conduit anode element, within the vacuum vessel (shown in FIGS. 3 and 4) is shown in accordance with the invention. Once the VFB conduit anode element(s) is placed in the vacuum vessel with the appropriate tooling elements to properly fill the vacuum vessel and remove any potential air gaps and the vacuum vessel is sealed with an air tight seal, the process starts in step 502 where the vacuum vessel is placed in a furnace (not shown). The gases (including air) within the vacuum vessel are pumped out of the vacuum vessel (i.e., evacuated), in step 504, to create a vacuum environment within the vacuum vessel. The temperature is then raised, in step 506, to a "firing temperature" such as, for example, between 850 to 1000 degrees Celsius. Once the firing range is reached, the temperature is maintained at the firing range temperature, in step 508, for a predetermined period of time that is determined by a predetermined desired outgassing level. The process then continues and the temperature is raised, in step 510, to the brazing temperature necessary to melt the brazing alloy. The brazing temperature is then maintained for a predetermined time, in step 512, to fully melt the brazing alloy. Once the brazing alloy has been melted properly, the temperature is decreased, in step 514, to ambient temperature. The vacuum vessel is then vented to a predetermined temperature to avoid oxidation. The process then ends in step 518.

Figure 6:
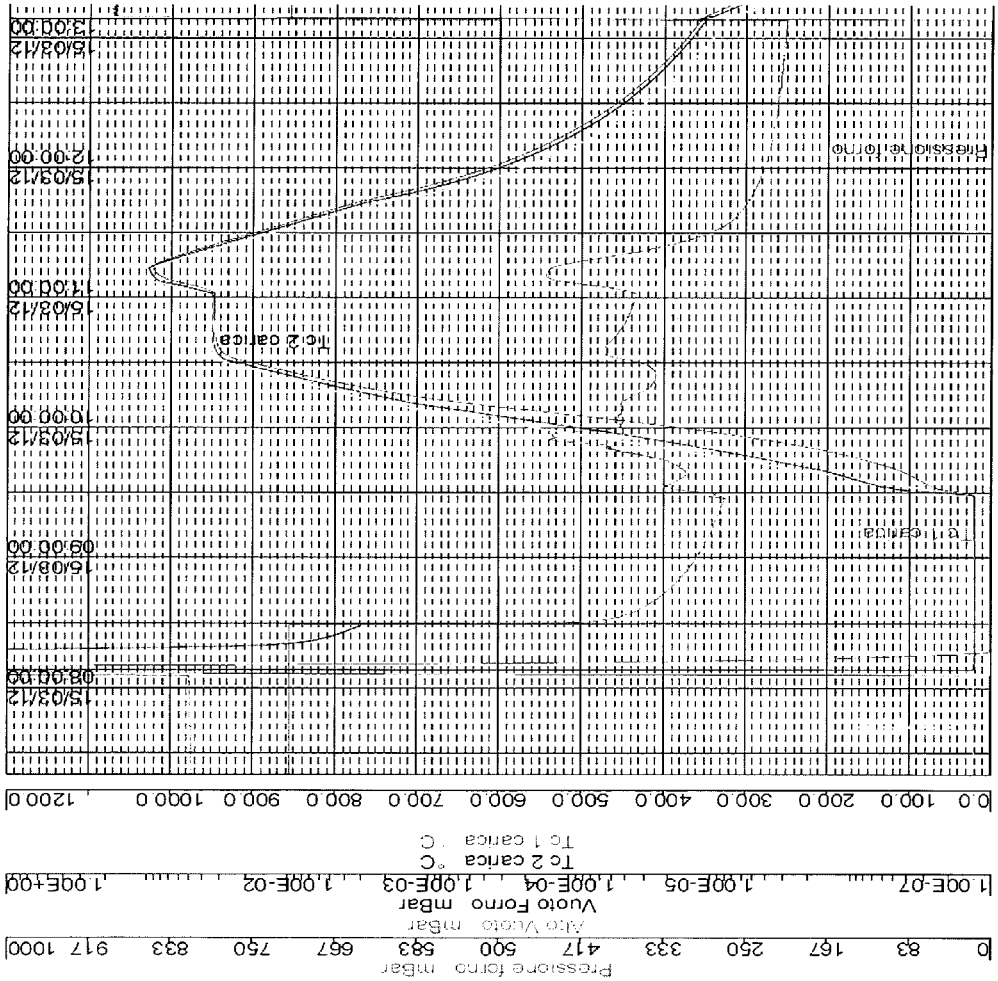
FIG. 6 is a graphical plot of pressure and temperature versus time for the brazing process for producing the VFB conduit anode element shown in FIG. 5.

In FIG. 6, a graphical plot 600 of pressure 602 and temperature 604 versus time 606 for the brazing process for producing the VFB conduit anode element (shown in FIG. 5) is shown.

Figure 7:
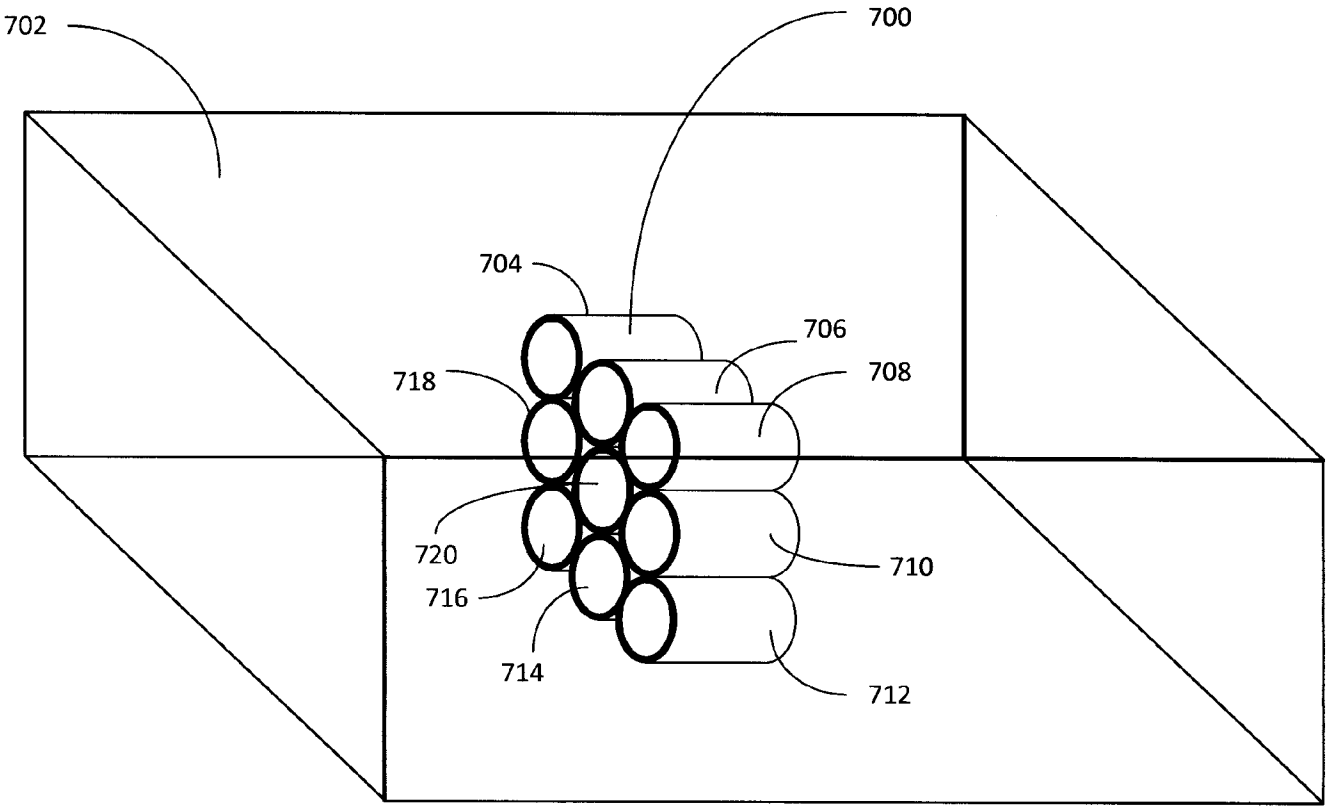
FIG. 7 is a perspective view of an example of an implementation of a VFB anode array element, within a vacuum vessel, for utilization in a Penning trap in accordance with the invention.

Turning to FIG. 7, a perspective view of an example of an implementation of a VFB anode array element 700, within a vacuum vessel 702, is shown for utilization in a Penning trap in accordance with the invention. In this example, a plurality of VFB conduit anode elements 704, 706, 708, 710, 712, 714, 716, 718, and 720 are shown. As stated above, the VFB conduit anode elements 704, 706, 708, 710, 712, 714, 716, 718, and 720 may include, for example, metal conduits that have a cross-sectional area defined by a square, rectangular, oval, tear-shaped, star, or other similar closed shapes. They may be constructed of stainless steel, aluminum, or other similar sheet metal. In this example, VFB conduit anode elements may include tooling elements similar to the ones shown in FIG. 3 of which the individual VFB conduit anode elements 704, 706, 708, 710, 712, 714, 716, 718, and 720 are wrapped around. The individual VFB conduit anode elements 704, 706, 708, 710, 712, 714, 716, 718, and 720 may either be fully formed VFB conduit anode elements or may be formed by individual sheet elements similar to the process described in FIG. 3.

Figure 8:
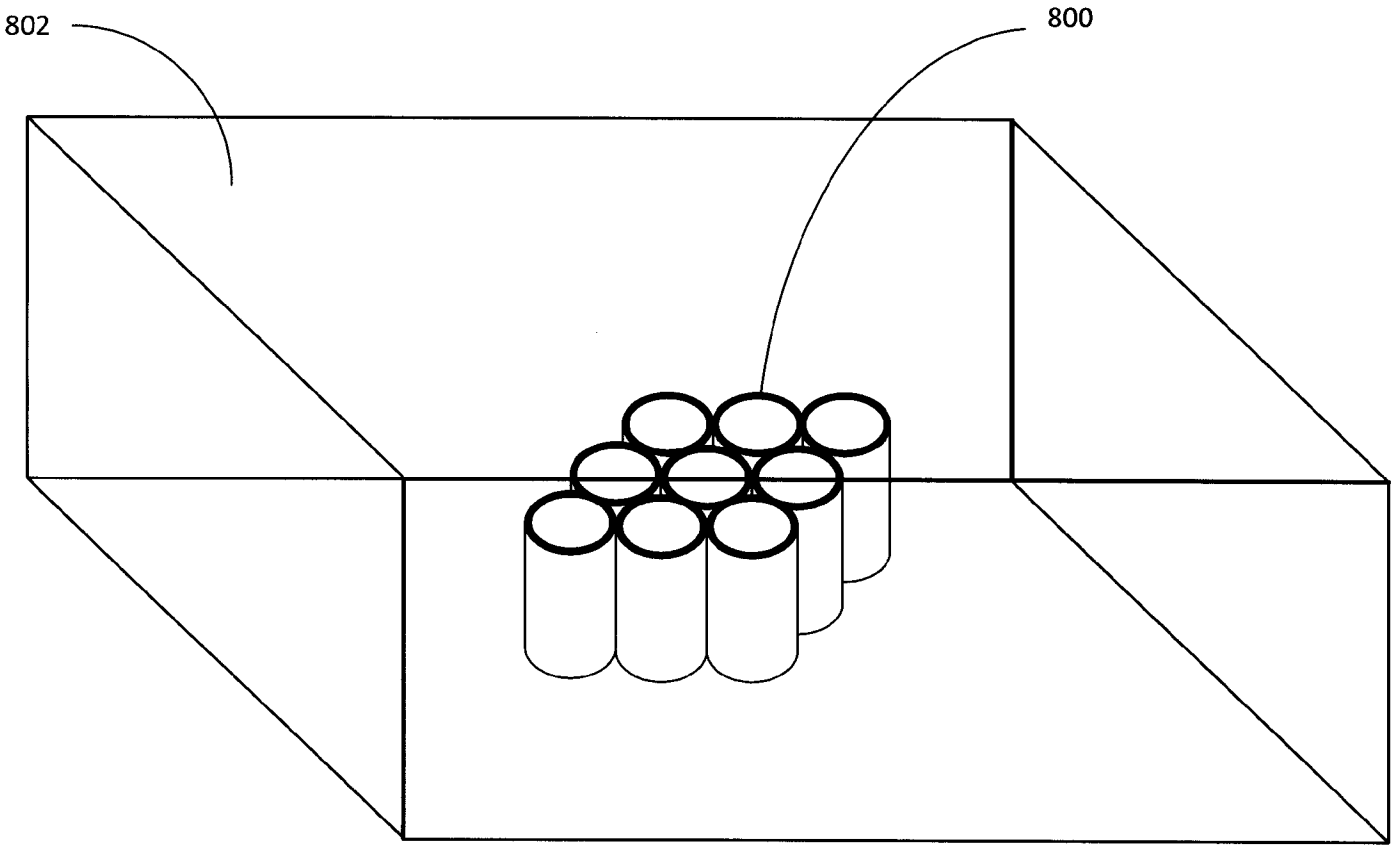
FIG. 8 is a perspective view of an example of another implementation of the VFB anode array element in a vertical brazing position within a vacuum vessel.

In this example, the individual VFB conduit anode elements 704, 706, 708, 710, 712, 714, 716, 718, and 720 are vacuum brazed together to form the VFB anode array element 700 using the same techniques described in FIGS. 3 through 6. Again, in this example, the brazing alloy may be a copper-gold brazing alloy. It is noted that in this example, the VFB conduit anode elements 704, 706, 708, 710, 712, 714, 716, 718, and 720 are shown laying horizontally to allow for horizontal brazing between the sides of the correspondingly adjacent VFB conduit anode elements 704, 706, 708, 710, 712, 714, 716, 718, and 720. Alternatively, the VFB conduit anode elements could be positioned in a vertical fashion to allow for vertical brazing between the sides of the correspondingly adjacent VFB conduit anode elements as shown in FIG. 8. In FIG. 8, the VFB anode array element 800 is shown in vertical brazing position within a vacuum vessel 802. Again, the tooling, and brazing process and materials would be the same as described earlier in FIGS. 3 through 7.

Figure 9A:
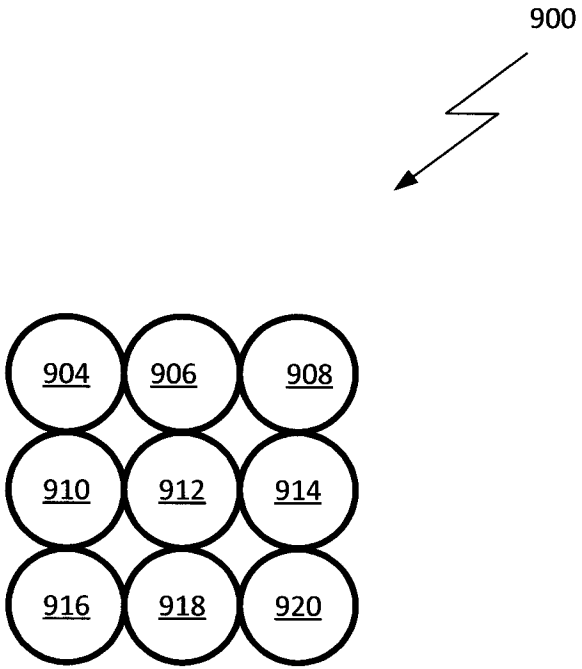
FIGS. 9A and 9B are front-views of two examples of an implementation of the VFB anode array element in accordance with the invention.
Figure 9B:
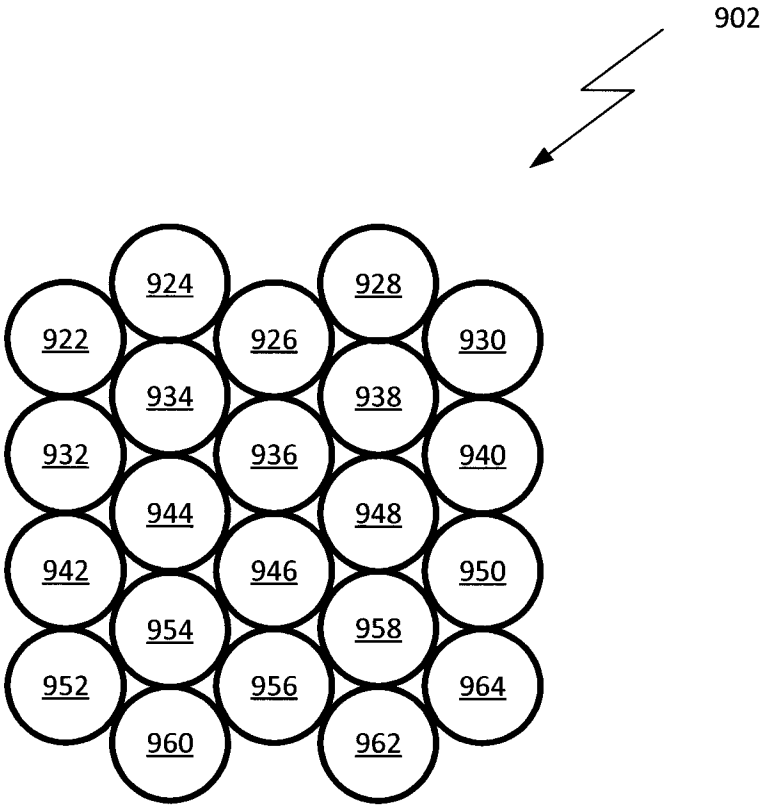

In FIGS. 9A and 9B, front-views of two examples of an implementation of the VFB anode array element 900 and 902 are shown. In FIG. 9A, nine individual VFB conduit anode elements 904, 906, 908, 910, 912, 914, 916, 918, and 920 are shown as making up the VFB anode array element 900 where VFB conduit anode elements 906, 910, 914, and 918, are adjacent to VFB conduit anode element 912 in the form of an rectangular matrix. Alternatively, in FIG. 9B, twenty two individual VFB conduit anode elements 922, 924, 926, 928, 930, 932, 934, 936, 938, 940, 942, 944, 946, 948, 950, 952, 954, 956, 958, 960, and 962 are shown as making up the VFB anode array element 902 where VFB conduit anode elements 934, 926, 938, 948, 946, and 944, are adjacent to VFB conduit anode element 936 in the form of an hexagonal matrix. It is appreciated that if other types of shapes are utilized for the VFB conduit anode elements the VFB anode array element matrices will also be different.

Figure 10:
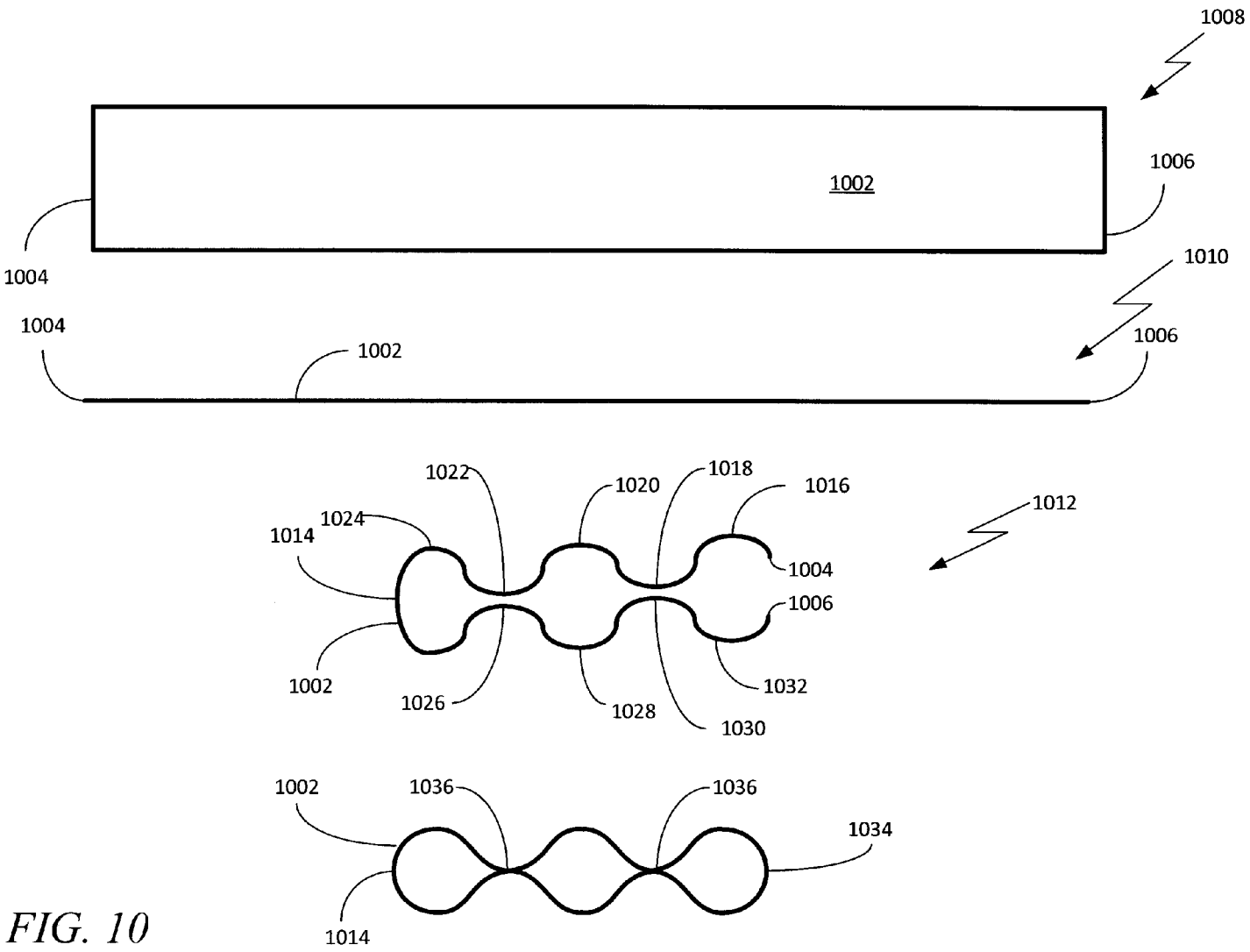
FIG. 10 is an assembly view of an example of another implementation of VFB anode subassembly of the VFB anode array elements shown in FIGS. 7 and 8 in accordance with the invention.

Turning to FIG. 10, an assembly view of an example of another implementation of VFB anode subassembly 1000 is shown of the VFB anode array elements shown in FIGS. 7 and 8. As stated earlier, the VFB anode array subassembly element 1000 may be constructed of stainless steel, aluminum, or other similar sheet metal. In this example, the VFB anode subassembly 1000 may be constructed of a sheet of stainless steel metal 1002 having a first edge 1004 and second edge 1006. In FIG. 10, a top-view 1008 is shown of the sheet of stainless steel metal 1002. Additionally, a side-view 1010 is also shown of the sheet of stainless steel metal 1002. In side-view 1012, the sheet of stainless steel metal 1002 is bent around point 1014 to form a metal sheet having waves that may be defined, for example, by arcs 1016, 1018, 1020, 1022, 1024, 1020, 1022, 1024, 1026, 1028, 1030, and 1032. With these arcs 1010, 1012, 1014, 1016, 1018, 1020, 1022, 1024, 1026, 1028, 1030, and 1032 the sheet of stainless steel metal 1002 may be bent on itself (around point 1014) such that the first edge 1004 and second edge 1006 are adjacent to each other. When placed in the vacuum vessel with tooling, the arcs 1022 and 1026 and arcs 1018 and 1030 may be abutted against each other and the first edge 1004 and second edge 1006 may be also be abutted to form the VFB anode subassembly 1000. The first edge 1004 and second edge 1006 would then form an edge brazing seal 1034 and the arcs 1022 and 1026 and arcs 1018 and 1030 would be brazed together at brazing seals 1036 and 1038, respectively.

Figure 11:
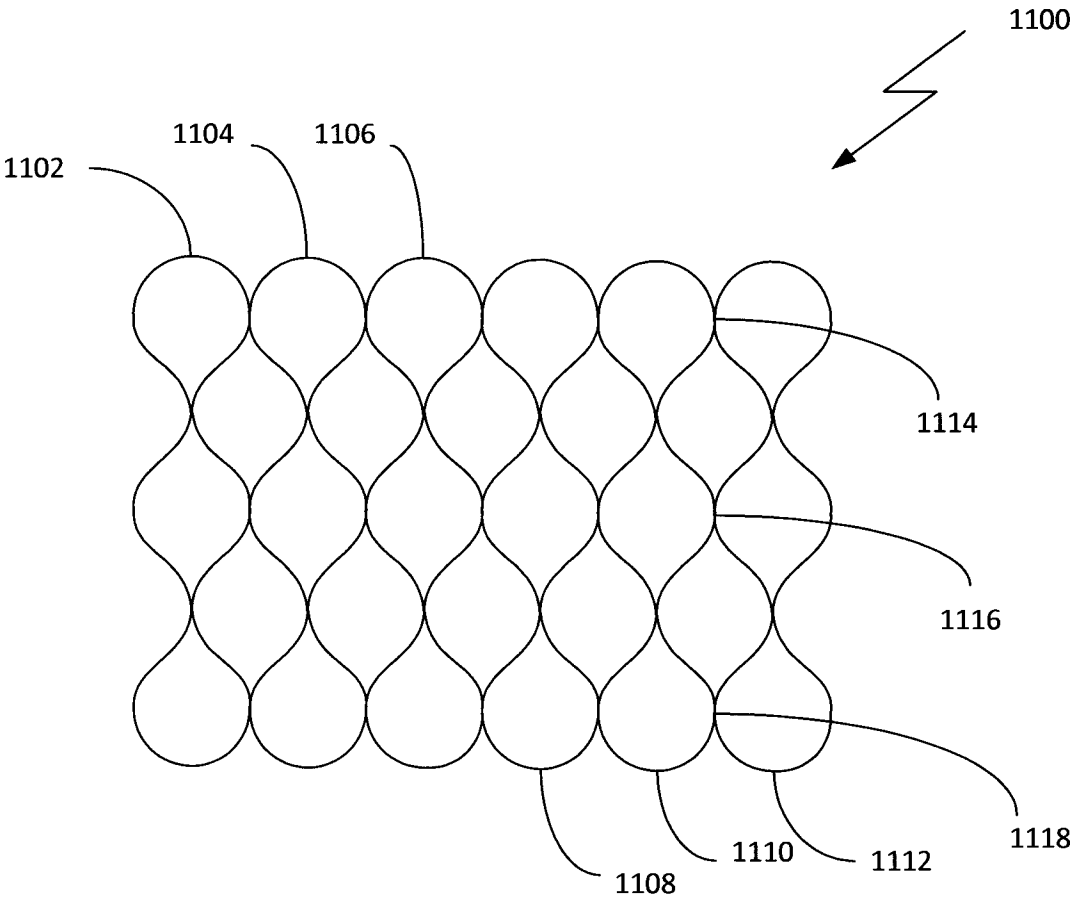
FIG. 11 is a front-view of an example of another implementation of the VFB anode array element based on VFB anode array subassembly element shown in FIG. 10 in accordance with the invention.

In FIG. 11, a front-view of an example of another implementation of the VFB anode array element 1100 is shown based on VFB anode array subassembly element shown in FIG. 10. In FIG. 11, six individual VFB anode array subassembly elements 1102, 1104, 1106, 1108, 1110, and 1112 are shown as making up the VFB anode array element 1100. In this example, the six individual VFB anode array subassembly elements 1102, 1104, 1106, 1108, 1110, and 1112 are brazed to each adjacent element. As an example, VFB anode array subassembly elements 1110 and 1112 are brazed together at braze seams 1114, 1116, and 1118, respectively.

Figure 1:
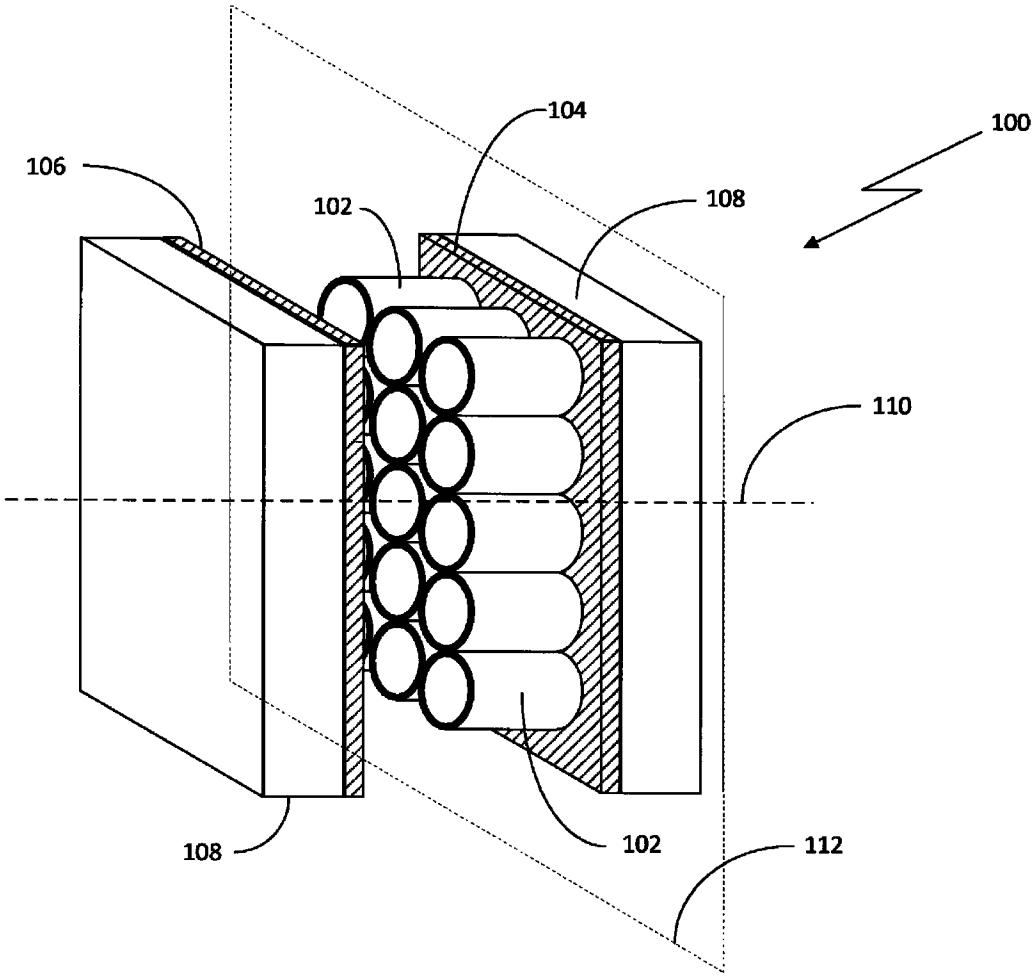
FIG. 1 (Prior Art)
FIG. 1 is a perspective view of an example of an implementation of a known Penning trap.
Figure 2:
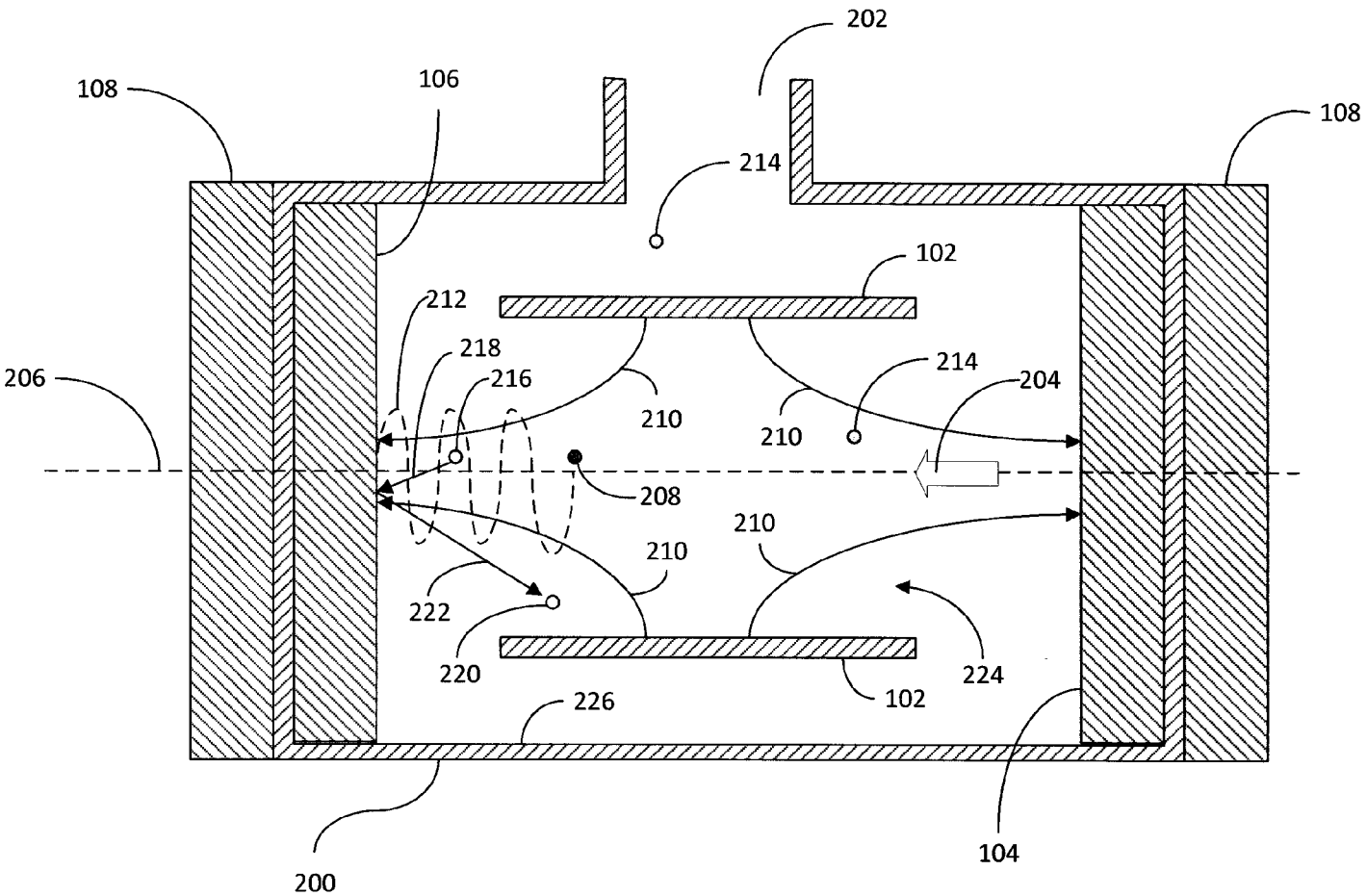
FIG. 2 (Prior Art)
FIG. 2 is a side-view of the Penning trap of FIG. 1 in combination with the vessel that has an inlet.

Additionally, it is appreciated that in addition to vacuum brazing the entire VFB anode array element, the cathodes 106 and 108 (from FIG. 1) may also be vacuum brazed together with the VFB anode array element.

Although the previous description only illustrates particular examples of various implementations, the invention is not limited to the foregoing illustrative examples. A person skilled in the art is aware that the invention as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A Vacuum Fired and Brazed ("VFB") conduit anode element for use in an ion pump, the VFB conduit anode element comprising;

a conduit comprising a sheet of metal surrounding a longitudinal axis of the conduit, the sheet comprising a first edge and a second edge facing each other to define a joint line extending along an elongated side of the conduit in parallel with the longitudinal axis; and a brazing seal disposed between and contacting the first edge and the second edge along the joint line, the brazing seal comprising a brazing alloy, wherein the first edge and second edge are brazed together utilizing a vacuum brazing process.

2. The VFB conduit anode element of claim 1, wherein the sheet of metal is stainless steel or aluminum, and wherein the brazing alloy is an aluminum alloy or a copper-gold brazing alloy.

3. A Vacuum Fired and Brazed ("VFB") anode array element for use in an ion pump, the VFB anode array element comprising:

a plurality of conduit anode elements according to claim 1, wherein the conduit anode elements are arranged in an array such that each conduit anode element is adjacent to at least one other conduit anode element; and a plurality of brazing seals disposed between and contacting respective pairs of adjacent conduit anode elements.

4. The VFB anode array element of claim 3, wherein the conduit anode elements comprise stainless steel or aluminum.

5. The VFB anode array element of claim 3, wherein the brazing seals comprise a copper-gold alloy or an aluminum alloy.

6. The VFB anode array element of claim 3, comprising:

a plurality of anode array subassemblies, each anode array subassembly comprising a group of the conduit anode elements, wherein at least one conduit anode element of each anode array subassembly is adjacent to a conduit anode element of at least one of the other anode array subassemblies; and a plurality of brazing seals disposed between and contacting adjacent conduit anode elements of respective adjacent anode array subassemblies.

7. The VFB anode array element of claim 6, wherein the conduit anode elements comprise stainless steel or aluminum, and the brazing seals comprise a copper-gold alloy or an aluminum alloy.

8. An electrode assembly, comprising:

the VFB anode array element of claim 3, wherein the conduit anode elements comprise respective first axial ends and opposing second axial ends, and the VFB anode array element has a side at which the first axial ends are located;

a cathode element adjacent to the first axial ends; and a plurality of brazing seals adjoining the cathode element with the first axial ends.

9. A method for producing a Vacuum Fired and Brazed ("VFB") anode array element for use in an ion pump, the method comprising:

placing a plurality of anode array subassemblies in a vacuum vessel, each anode array subassembly comprising a group of conduit anode elements, wherein the anode array subassemblies are placed such that an elongated side of at least one conduit anode element of each anode array subassembly is in physical contact with or in close proximity to an elongated side of at least one adjacent conduit anode element of an adjacent anode array subassembly;

placing a brazing alloy at locations between adjacent conduit anode elements of respective adjacent anode array subassemblies where the respective elongated sides of the adjacent conduit anode elements are in physical contact with or in close proximity to each other;

sealing the vacuum vessel;

placing the vacuum vessel in a furnace;

evacuating any gases from the vacuum vessel;

raising the temperature of the vacuum vessel with the furnace to a firing temperature;

maintaining the firing range temperature for a predetermined period of time;

raising the temperature to a brazing temperature for melting the brazing alloy;

maintaining the brazing temperature for a predetermined time to fully melt the brazing alloy; and lowering the temperature to ambient temperature.

10. The method of claim 9, wherein lowering the temperature to ambient temperature comprises venting the vacuum vessel so as lower the temperature to a predetermined temperature to avoid oxidation.

11. The method of claim 9, wherein the firing temperature is between 850 to 1000 degrees Celsius.

12. The method of claim 9, wherein the predetermined period of time for maintaining the firing range temperature is determined by a predetermined desired outgassing level.

13. The method of claim 9, wherein lowering the temperature to ambient temperature includes determining that the brazing alloy has been fully melted.

14. The method of claim 9, wherein the conduit anode elements are composed of stainless steel or aluminum.

15. The method of claim 9, wherein the brazing alloy comprises an aluminum alloy or a copper-gold alloy.

16. The method of claim 9, wherein, in each anode array subassembly, the conduit anode elements are arranged such that an elongated side of each conduit anode element is in physical contact with or in close proximity to an elongated side of at least one adjacent conduit anode element, and further comprising:

for each anode array subassembly, placing the brazing alloy at locations between adjacent conduit anode elements of the each anode array subassembly where the respective elongated sides of the adjacent conduit anode elements are in physical contact with or in close proximity to each other.

17. The method of claim 9, wherein each anode array subassembly comprises a sheet formed into alternating outwardly curved arcs and inwardly curved arcs, and the sheet is bent around a contact point such that each outwardly curved arc is opposite to another outwardly curved arc, and each inwardly curved arc is adjacent to another inwardly curved arc, and further comprising:

placing the brazing alloy between adjacent inwardly curved arcs, wherein raising the temperature to the brazing temperature, maintaining the brazing temperature, and lowering the temperature brazes the adjacent inwardly curved arcs together at a brazing seal, and each conduit anode element is defined by a pair of opposite outwardly facing arcs and at least one brazing seal.

18. A Vacuum Fired and Brazed ("VFB") anode array element for use in an ion pump, the VFB anode array element comprising:

a plurality of anode array subassemblies, each anode array subassembly comprising a sheet formed into alternating outwardly curved arcs and inwardly curved arcs, wherein the sheet is bent around a contact point such that each outwardly curved arc is opposite to another outwardly curved arc, and each inwardly curved arc is adjacent to another inwardly curved arc, wherein the anode array subassemblies are arranged such that at least one outwardly curved arc of each anode array subassembly is adjacent to an outwardly curved arc of another anode array subassembly;

a plurality of brazing seals disposed between and contacting adjacent outwardly curved arcs of respective adjacent anode array subassemblies; and a plurality of brazing seals disposed between and contacting adjacent inwardly curved arcs of each anode array subassembly, wherein each anode array subassembly comprises a plurality of conduit anode elements, and each conduit anode element is defined by a pair of opposite outwardly facing arcs and at least one brazing seal.

19. The VFB anode array element of claim 9, wherein the conduit anode elements comprise stainless steel or aluminum, and the brazing seals comprise a copper-gold alloy or an aluminum alloy.

20. An electrode assembly, comprising:

the VFB anode array element of claim 9, wherein the conduit anode elements comprise respective first axial ends and opposing second axial ends, and the VFB anode array element has a side at which the first axial ends are located;

a cathode element adjacent to the first axial ends; and a plurality of brazing seals adjoining the cathode element with the first axial ends.

* * * * *